US006062454A

United States Patent [19]

Morishige et al.

[11] Patent Number: 6,062,454

[45] **Date of Patent: *May 16, 2000**

[54] SHEET BINDING APPARATUS HAVING NEEDLE DETECTION MEANS, AND IMAGE FORMING APPARATUS

[75] Inventors: Yuji Morishige; Noriyoshi Ueda, both of Yokohama; Kathuhito Kato, Kawasaki; Kenji Kobayashi, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,944

[22] Filed: Jul. 15, 1997

Related U.S. Application Data

[63] Continuation of application No. 08/327,808, Oct. 24, 1994, abandoned, which is a continuation of application No. 08/069,851, Jun. 1, 1993, abandoned.

[30] Foreign Application Priority Data

Jun. 3, 1992 [JP] Japan ..... 4-142763

[51] Int. Cl.[7] ..... B27F 7/36; B27F 7/23

[52] U.S. Cl. ..... 227/2; 227/5; 227/1

[58] Field of Search ..... 227/1, 6, 7, 2, 227/5

[56] References Cited

U.S. PATENT DOCUMENTS

| | | | |
|---|---|---|---|
| 4,703,881 | 11/1987 | Riddell | 227/1 |
| 4,750,661 | 6/1988 | Pane | 227/1 X |
| 5,105,225 | 4/1992 | Honjo et al. | 355/233 |
| 5,161,724 | 11/1992 | Radtke et al. | 227/7 X |
| 5,230,457 | 7/1993 | Hiroi et al. | 227/6 X |

*Primary Examiner*—Rinaldi I. Rada
*Assistant Examiner*—Boyer Ashley
*Attorney, Agent, or Firm*—Fitzpatrick, Cella, Harper & Scinto

[57] ABSTRACT

The present invention provides a sheet binding apparatus for effecting stapling operation by rotation of a motor including a current measuring device for measuring a current of the motor, a first timing output device for defining the timing of the stapling operation, a second timing output device for effecting the output at a different timing from an output timing of the first timing output device, a calculation device for measuring outputs of the current measuring device in response to signals from the first and second timing output devices to seek the difference between the measured values, a base current measuring device capable of setting a current value in advance on which the judgement of the presence/absence of a needle is based, and a discriminating device for comparing an output value from the calculation device with a set value of the base current value setting device to judge the presence/absence of the needle.

36 Claims, 6 Drawing Sheets

POINT OF Ⓐ

SHEET BINDING APPARATUS HAVING NEEDLE DETECTION MEANS, AND IMAGE FORMING APPARATUS

This application is a continuation of application Ser. No. 08/327,808 filed Oct. 24, 1994, now abandoned, which is a continuation of application Ser. No. 08/069,851, filed Jun. 1, 1993, now abandoned.

BACKGROUND OF THE INVENTION

1. Field of the Invention

The present invention relates a sheet binding apparatus having means for detecting the presence/absence of a needle, and an image forming apparatus having the binding apparatus. More particularly, it relates to a sheet binding apparatus wherein a stapling operation is effected by the aid of the rotation of a motor and which has means for electrically detecting the presence/absence of a needle.

2. Related Background Art

Conventionally, the presence of a needle or staple in a sheet binding apparatus has been physically detected by a photo-sensor of the permeable type or reflection type. However, in such a conventional technique, since the photo-sensor of permeable type or reflection type was required for detecting the needle, it was difficult to make the sheet binding apparatus small-sized due to the installation space for the photo-sensor and difficult to make the apparatus inexpensive.

SUMMARY OF THE INVENTION

The present invention aims to eliminate the above-mentioned conventional drawback, and has an object to provide a sheet binding apparatus which is compact and inexpensive and wherein the presence/absence of a needle (not limited to a needle in a stapler, but may be any needles in other binding means) can be correctly detected.

A sheet binding apparatus of the present invention wherein a stapling operation is effected by the rotation of a motor is characterized by that current measuring means for measuring a current of the motor, first timing output means for defining the timing of the stapling operation, second timing output means for effecting the output at a different timing from an output timing of the first timing output means, calculation means for measuring an output of the current measuring means in response to signals from the first and second timing output means and for seeking the difference between the measured values, base current value setting means capable of previously setting a current value on which the judgement of the presence/absence of the needle is based, and discriminating means for comparing an output value from the calculation means with a set value of the base current value setting means to judge the presence/absence of the needle.

In operation, since the current value of the motor for effecting the stapling operation is varied due to the difference in the load of the motor between the presence of the needle and the absence of the needle, it is possible to detect the presence/absence of the needle by providing the timing defining means and the current detecting means, thus making the sheet binding apparatus small-sized and inexpensive. Further, by measuring the current value of the second timing other than the stapling timing and by using the measured current value to correct the stapling current, it is possible to reduce the error due to the dispersion in the load in the stapling mechanism and/or the dispersion in the motor, thus improving the detecting accuracy.

As mentioned above, according to the present invention, since the presence of the needle is not physically detected but the current value of the motor for effecting the stapling operation is measured at the particular timing, it is possible to eliminate the provision of any sensor or the like, thereby making the sheet binding apparatus small-sized and inexpensive.

Further, by providing the second current measuring timing representative of the load in the mechanism other than the stapling operation and by measuring such current, it is possible to correct a component of the current value (which included in the stapling current) dispersed or varied in accordance with the load in the mechanism, thereby improving the accuracy of the needle detection.

DETAILED DESCRIPTION OF THE PREFERRED EMBODIMENTS

Figure 1:
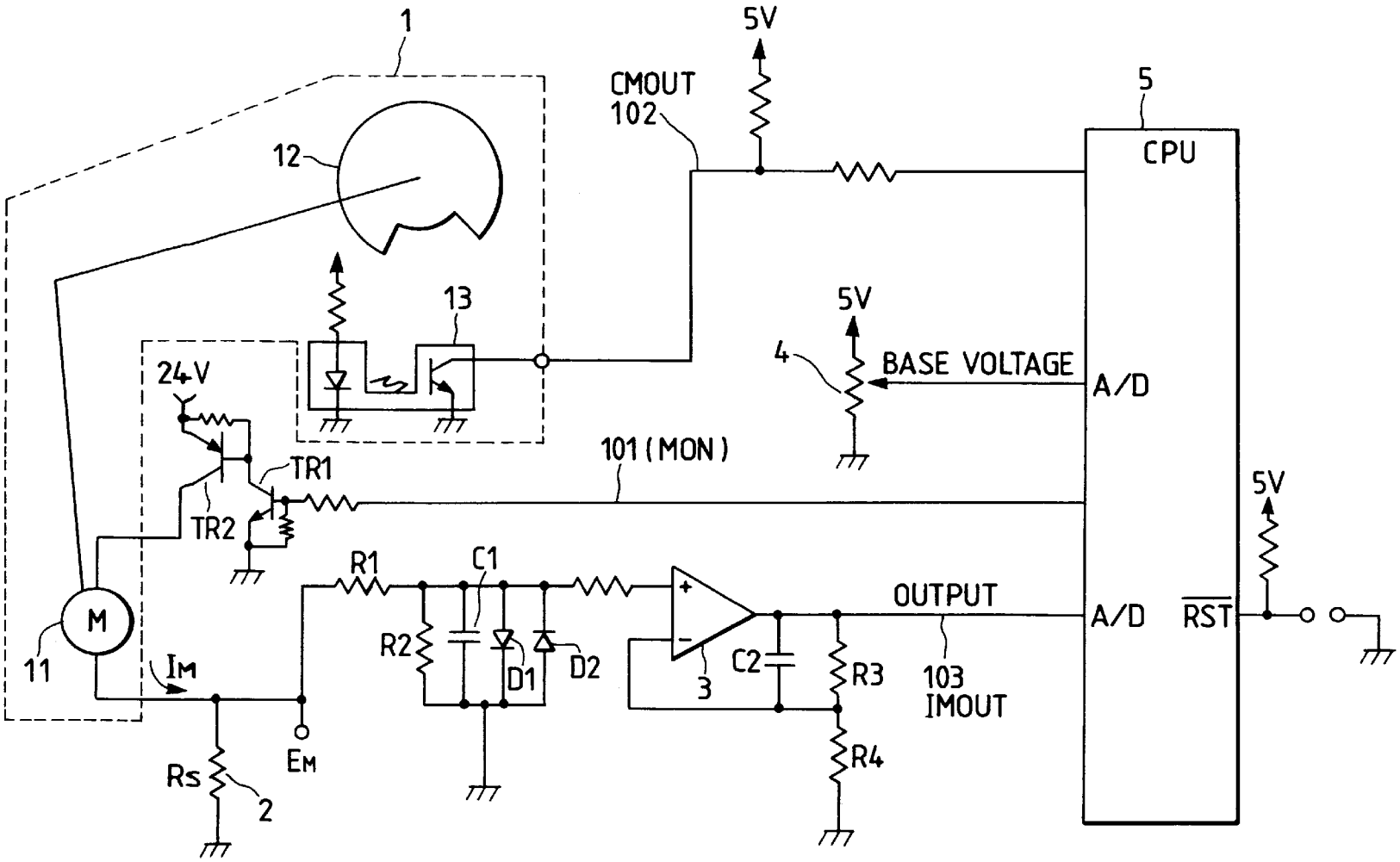
FIG. 1 is an electric circuit of a sheet binding apparatus according to a preferred embodiment of the present invention.

In FIG. 1 showing a first embodiment of the present invention, a staple unit 1 for effecting a stapling operation is constituted by a motor 11, a cam 12 cooperating with the motor 11 to effect the stapling operation, and a cam sensor 13 for detecting the position of the cam 12. A current detecting resistor 2 serves to convert a current of the motor into a voltage. An amplifier 3 serves to amplify the voltage detected by the current detecting resistor 2. An adjusting volume 4 serves to determine a threshold value for judging the presence/absence of a needle. A CPU 5 serves to control the drive of the staple unit 1 and to judge the presence/absence of the needle.

Next, the staple unit 1 will be fully described with reference to FIG. 2.

Figure 2:
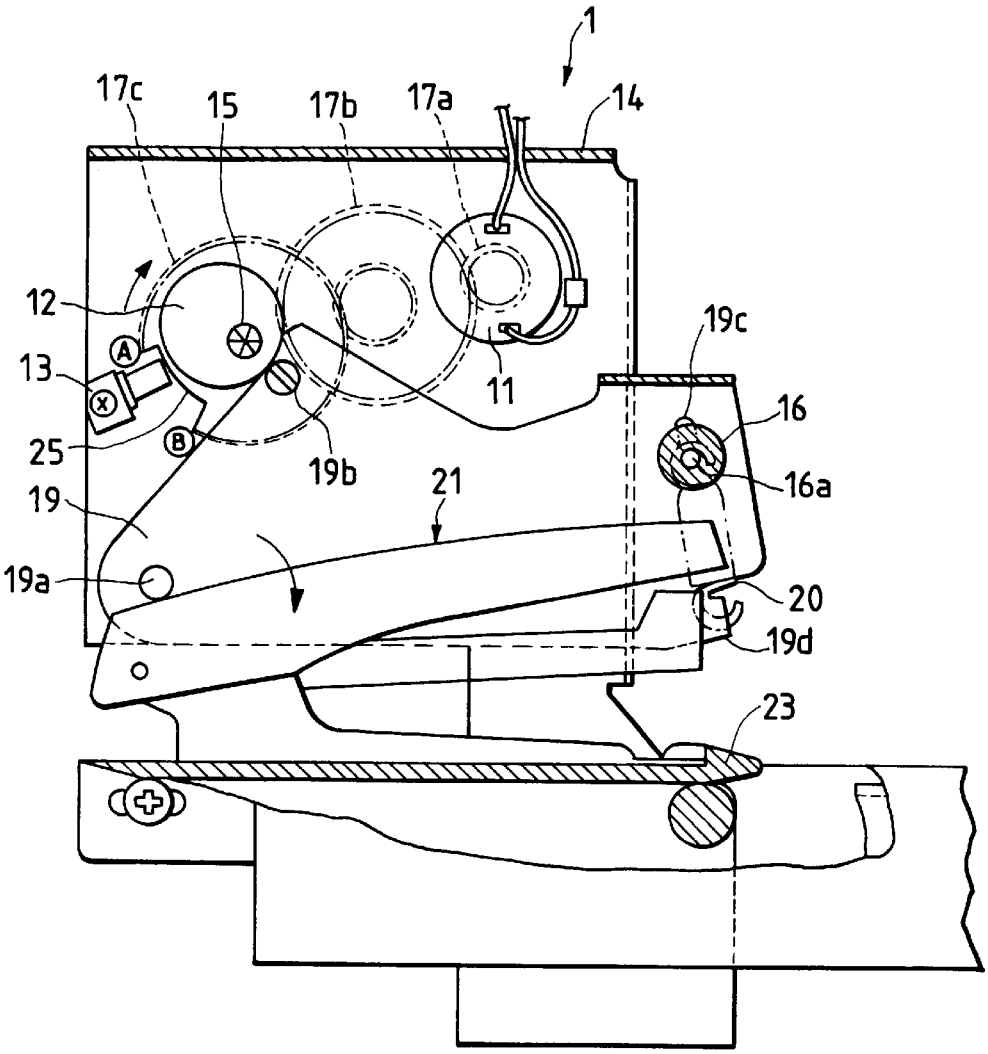
FIG. 2 is a sectional view of a mechanical portion of the sheet binding apparatus.

In FIG. 2, an eccentric cam 12 is secured to a support shaft 15 rotatably supported by a frame 14, and a rotational force of the motor 11 is transmitted to the eccentric cam 12 via a pinion 17*a*, a two-stage gear 17*b* and a gear 17*c* secured to the support shaft 15. A base of a rocker member 19 is pivotally mounted on the frame via a pivot 19*a*. The rocker member 19 is biased in a counter clockwise direction by a spring (not shown) so that a roller 19*b* on the rocker member 19 is abutted against the eccentric cam 12.

A shaft 16*a* on which a hold-down roller 16 is mounted is freely received in an elongated slot 19*c* formed in a free end portion of the rocker member 19, and a tension spring 20 is connected between the shaft 16*a* and a lower end 19*d* of the rocker member 19. The hold-down roller 16 is opposed to a stapler 21 and can be moved in an up-and-down direction in response to the rotation of the motor 11. When the hold-down roller 16 (and accordingly the rocker member 19) is lowered, a head of the stapler 21 is also lowered, thereby driving a needle into a sheet stack. Thereafter, when the hold-down roller 16 is lifted, the stapler 21 is also lifted.

A notched disc 25 rotated in synchronous with the eccentric cam 12 is secured to the support shaft 15. The sensor 13 so disposed that a first signal is generated by one edge A of the notch and a second signal is generated by the other edge B of the notch in a condition that the stapler 21 is lowered to a lowermost position.

With the arrangement mentioned above, when a staple command is inputted, the CPU 5 turns ON a motor drive transistor TR2 to change a motor drive signal (MON) 101 (FIG. 1) to a H (high) level, thereby starting to flow a motor current IM to cause the motor 11 to rotate.

A voltage EM detected by the current detecting resistor 2 becomes as follows:

$$EM=Rs\times IM \quad (Rs\text{: current detecting resistance})$$

The detected voltage EM is inputted to the amplifier 3 through a voltage divider and low-pass filter circuit comprising resistors R1, R2 and a capacitor C1. Incidentally, the input to the amplifier 3 is limited by diodes D2, D1.

The amplifier 3 comprises a non-inversion amplifying circuit which keeps the high input impedance and wherein the amplification degree is determined by resistors R3, R4. Further, a capacitor C2 together with the resistors R3, R4 constitute a low-pass filter circuit, thereby preventing the amplification of a noise voltage.

Figure 3:
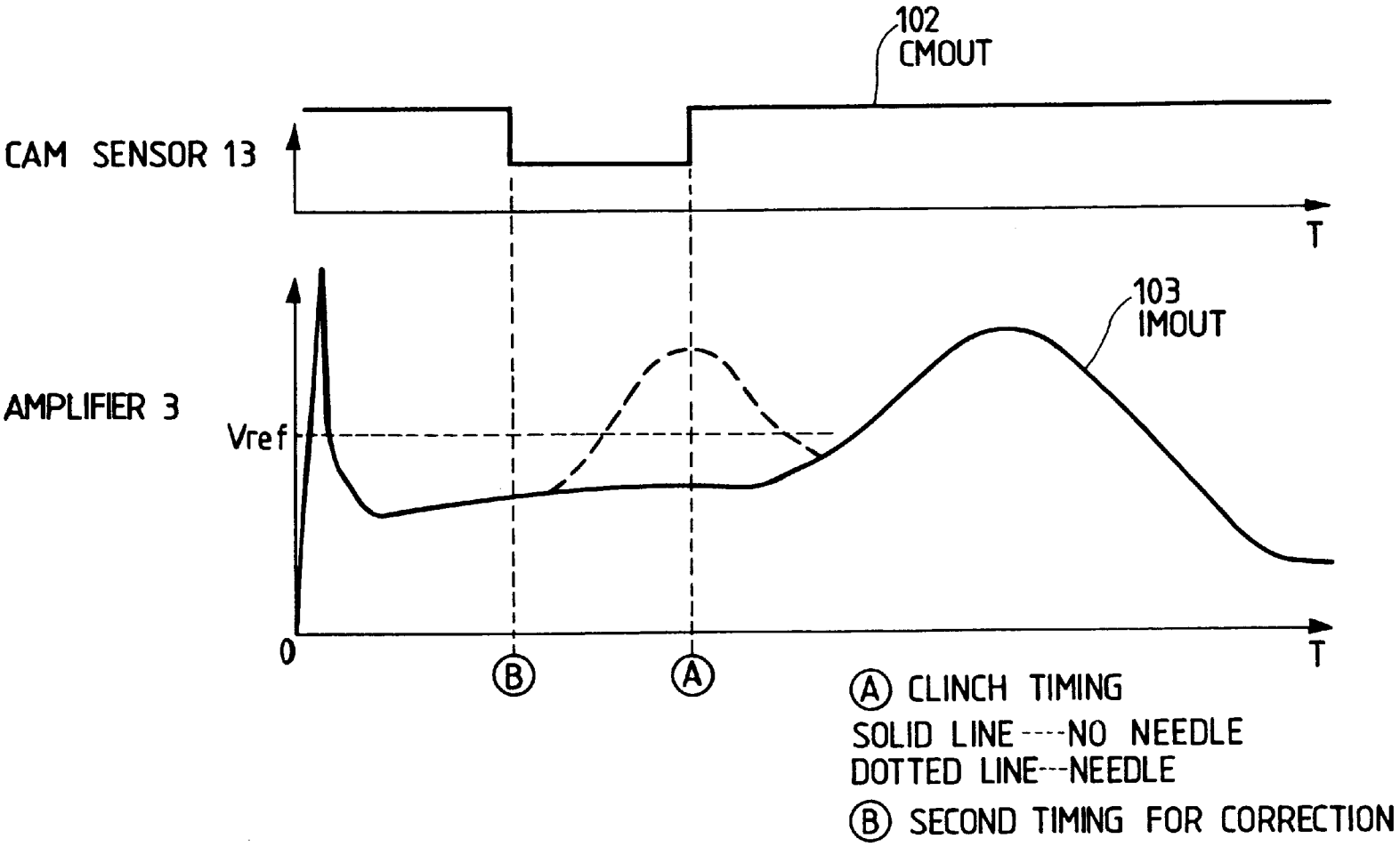
FIG. 3 is a graph showing a relation between an output voltage of an amplifier and an output of a timing sensor regarding a current flowing in a motor, and a time elapsed after the motor starts to rotate.

FIG. 3 shows a relation between an output (CMOUT) 102 of the cam sensor 13 and an output (IMOUT) 103 of the amplifier 3. Regarding wave shapes of the output (IMOUT) 103 shown in FIG. 3, the solid line shows a wave shape when there is no needle in the staple unit, and the dotted line shows a wave shape when there is a needle in the unit.

Figure 4:
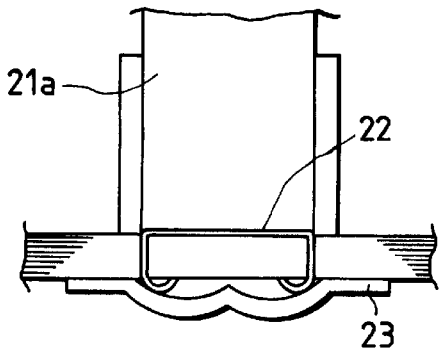
FIG. 4 is a front view of a push blade showing a condition of a stapler at a first timing output.

Ⓐ timing is a needle clinch timing wherein, as shown in FIG. 4, the needle 22 is completely bent against a base (anvil) 23 by the head 21*a* of the stapler 21. On the other hand, Ⓑ timing is a second timing before the clinch of the needle 22, which represents a condition including the dispersion in the load in the mechanism (which load does not vary the current regardless of the presence and absence of the needle 22) and the dispersion in the motor 11.

Further, regarding the output (CMOUT) 102 of the cam sensor 13, the clinch timing can be obtained from the rise of the output wave and the second timing can be obtained from the fall of the output wave.

The CPU 5 A/D-converts the voltage input of the output (IMOUT) 103 of the amplifier 3 on the basis of the fall and rise of the output (CMOUT) 102. The difference in the A/D-converted output values at the respective timings is calculated, and the calculated value is used as a current value for the stapling operation. By comparing this current value with the threshold value (for judging the presence/absence of the needle) previously set by the adjusting volume 4, the presence/absence of the needle is determined.

Now, the threshold value Vref is set as follows:

(1) A setting mode is selected, and a current value in no needle condition (20 sheets) is measured;

(2) A threshold current value is set on the basis of the no needle current value measured by the CPU (For example, threshold current value is equal to no needle current value+40 mA); and (3) A volume is used as a means for storing and holding the threshold current value even when the power source is turned OFF, and the volume is set to a value corresponding to the threshold current value.

An output VR of the volume is in a range of 0–5 Volts, and the CPU substitutes such voltage values for corresponding threshold current values. Incidentally, a substitution table is shown in the following Table 1.

TABLE 1

| VR | Threshold Current Value |
|---|---|
| 0 to 1 V | 200 mA |
| 1 to 2 V | 220 mA |
| 2 to 3 V | 240 mA |
| 3 to 4 V | 260 mA |
| 4 to 5 V | 280 mA |

Figure 5:
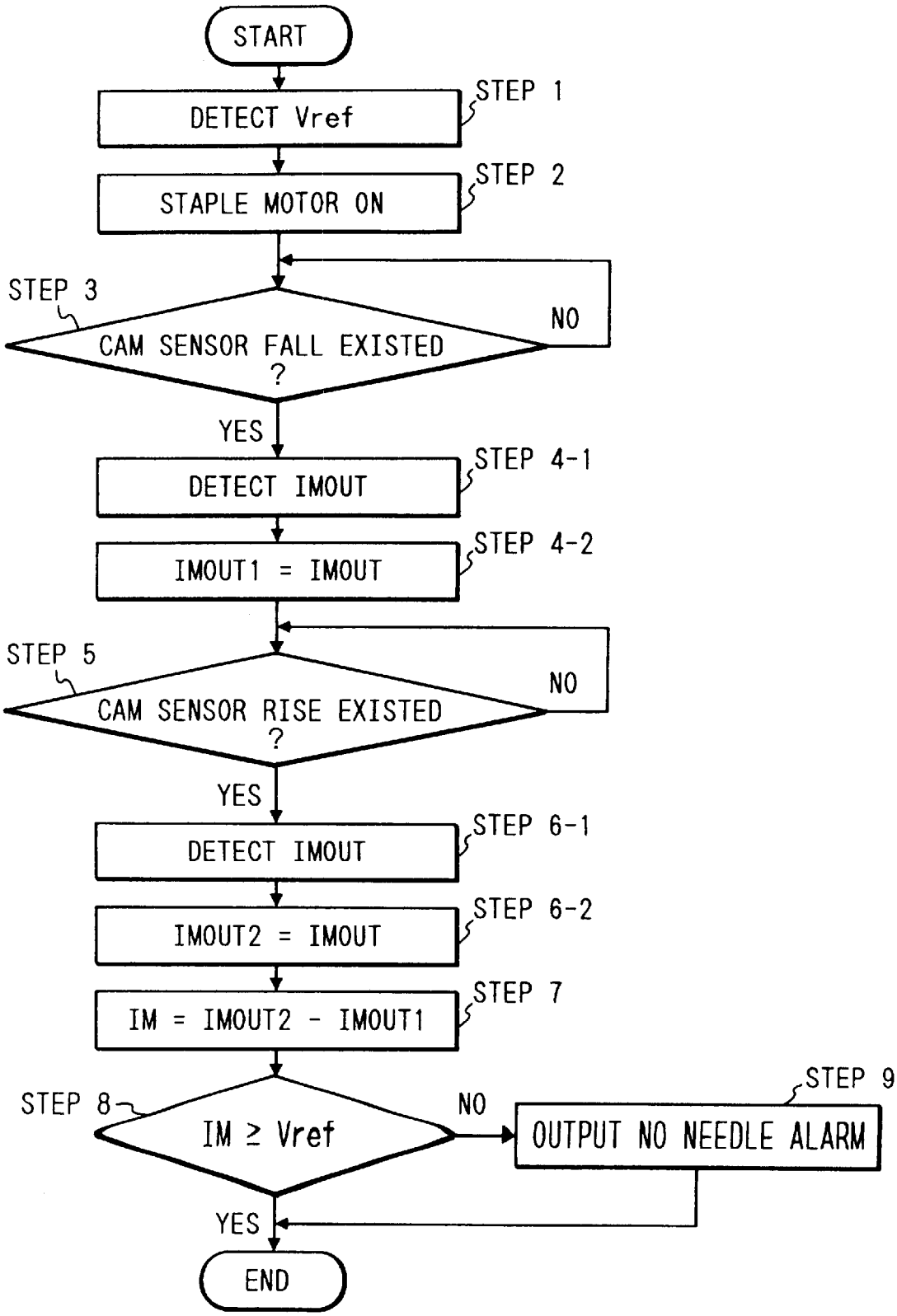
FIG. 5 is a flow chart for explaining an operation of the sheet binding apparatus.

FIG. 5 is a flow chart showing the operation for detecting the presence/absence of the needle effected by the CPU 5.

After the power source is turned ON, the CPU 5 A/D-converts the value of the adjusting volume to obtain the threshold value (Vref) for judging the presence/absence of the needle, and this value is stored in a RAM of the CPU (step 1). Then, the motor 11 is started (step 2), and it is judged whether there is the fall of the output (CMOUT) 102 or not (step 3). In the step 3, if the fall of the output (CMOUT) 102 is inputted, the output (IMOUT) at that timing is detected and the detected output is A/D-converted (step 4-1). Then, the value is stored in the RAM as IMOUT 1 (step 4-2).

Then, it is judged whether there is the rise of the output (CMOUT) 102 or not (step 5); if the rise is inputted, the output (IMOUT) at that timing is detected and the detected output is A/D-converted (step 6-1). Then, the value is similarly stored in the RAM as IMOUT (step 6-2). Then, from the IMOUT 1 and IMOUT 2 obtained in this way, the difference therebetween is calculated to obtain a value IM (step 7). The value IM is compared with the threshold value Vref read in the step 1; if IM>Vref, it is judged that the needle exists in the staple unit (step 8), whereas, if IM<Vref, it is judged that the needle does not exist in the staple unit and a no needle alarm is emitted (step 9).

Incidentally, in the illustrated embodiment, while an example that the first and second timings are set by the cam was explained, the present invention is not limited to this example, but, for example, the timings may be set at predetermined times after the motor is started, by using an appropriate timer.

Next, an example that the above-mentioned staple unit 1 is applied to a staple sorter attached to an image forming apparatus (copying machine) will be explained.

Figure 6:
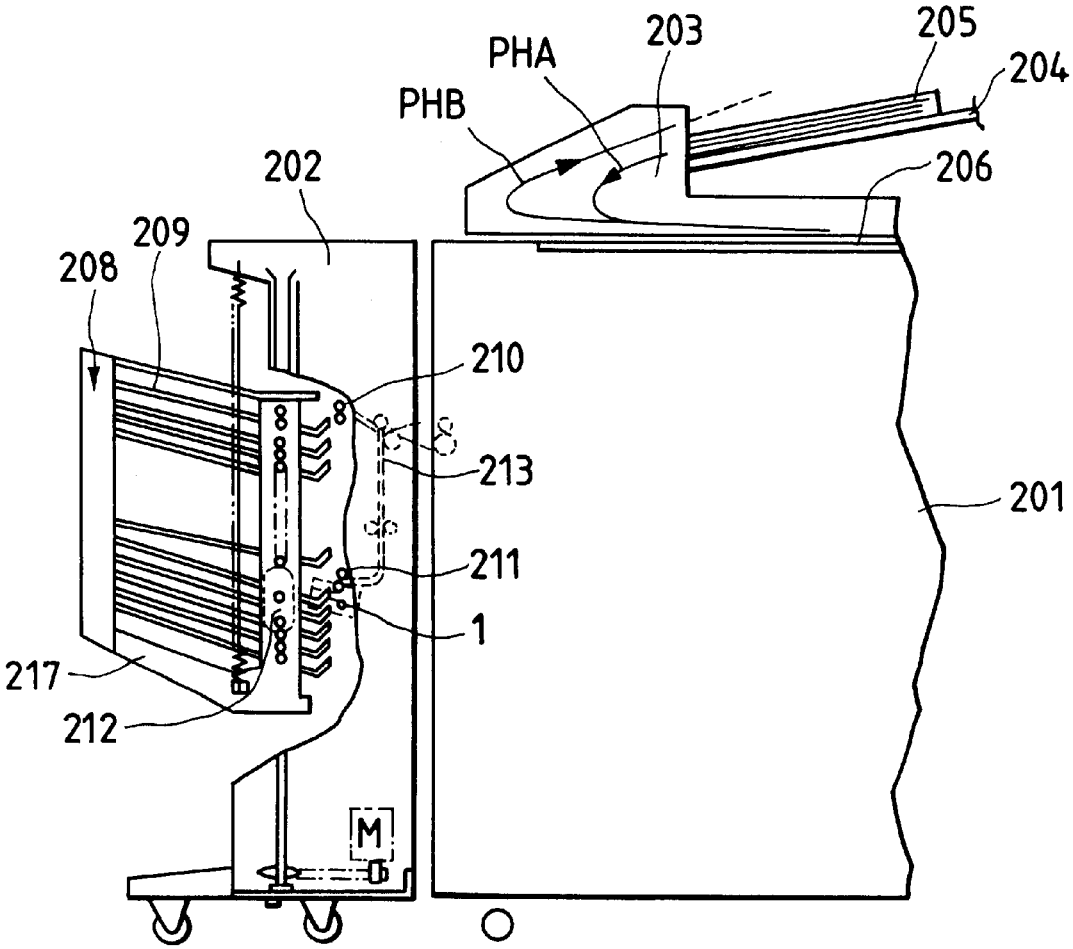
FIG. 6 is a front view of a staple sorter of a copying machine to which the sheet binding apparatus is applied.
Figure 7:
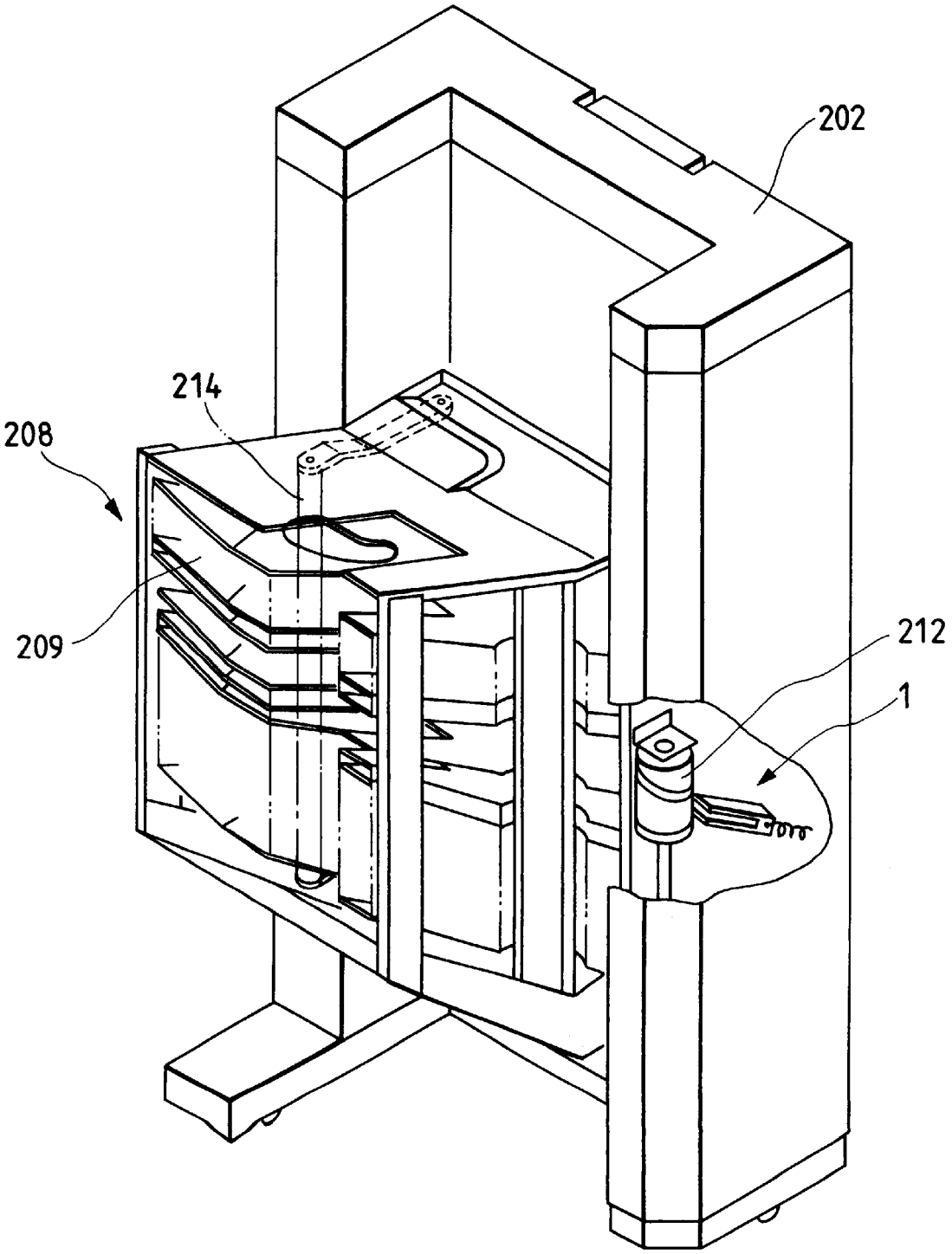
FIG. 7 is a perspective view of the staple sorter of FIG. 6.

In FIG. 6, the reference numeral 201 denotes a copying machine; 202 denotes a staple sorter; and 203 denotes an automatic original feeder.

In the automatic original feeder 203, originals 205 rested on an original support 204 with imaged surfaces facing are successively fed, from the lowermost one, to a platen glass 206 of the copying machine 201 through a path PHA. After each original is stopped on the platen glass, an optical system (not shown) is operated to start the image formation. After transferring and fixing operations, a copy sheet is discharged into the staple sorter 202. After the exposure of the original is finished, the original on the platen glass 206 is ejected onto the original stack 205 on the original support through a path PHB. Incidentally, a partition lever (not shown) is positioned between non-treated originals and the treated originals. The copy sheets ejected from the copying machine 201 are contained in suitable bins in accordance with the transfer treatment mode and/or the number of copy sheets. The above-mentioned operations are repeated by times corresponding to the number of originals.

The staple sorter 202 comprises a first convey means 210 for a non-sort mode, a second convey means 211 for a sort mode, a spiral cam 212 for shifting a bin group 208 upwardly and downwardly and for widening a bin opening to facilitate the insertion of the copy sheet, a switching means 213 for switching the feeding of the copy sheet between the first and second convey means, and the staple unit 1 positioned at the second convey means.

Further, the bin group 208 is provided with an alignment member 214 for aligning the sheets contained in the bins, and a drive means (not shown) (for example, comprising a stepping motor and gears). When a operator turns ON a copy start switch, the alignment member 214 is returned to a home position, and, when a sheet size signal is inputted from the copying machine 201, the alignment member is waiting at a position spaced apart from the side edges of the sheets by a predetermined amount. Whenever the sheet is contained in the bin 209, the alignment member 214 is abutted against the side edge of the sheet, thereby aligning the sheets. This operation is repeated whenever the sheet is contained in the bin.

The staple unit positioned at the second convey means can be advanced and retracted. Normally, the staple unit is retracted from the sheet path, and, when the stapling operation is effected, the staple unit is advanced to drive the needle into the sheet stack.

While an example that the present invention is applied to the staple unit associated with the staple sorter was explained, the present invention is not limited to this example, but may be applied to any electrically powered staplers.

What is claimed is:

1. A sheet binding apparatus for effecting a stapling operation in which a needle is pressed into a sheet stack by moving a head by operation of a motor, comprising:

first timing output means for outputting a signal at a timing of a needle pressing operation;

second timing output means for outputting a signal at a timing other than the timing of the needle pressing operation;

electrical load measuring means for measuring an electrical load value on the motor when the head moves, in response to the signals from said first and second timing output means;

base value setting means for setting an electrical load base value on which a judgement of the presence and absence of the needle is based; and judging means for calculating a difference value between electrical load values measured by the electrical load measuring means in response to signals from said first and second timing output means and for comparing the difference value with the value set by said base value setting means to judge the presence and absence of the needle.

2. A sheet binding apparatus according to claim 1, wherein the signal output by said first timing output means is output at a timing of a needle clinching operation.

3. A sheet binding apparatus according to claim 2, wherein said first and second timing output means comprise in combination rotary means which is rotated synchronously with the rotation of the motor for pressing the needle into the sheet stack, with a sensor for detecting a position of said rotary means.

4. A sheet binding apparatus according to claim 2, wherein said first and second timing output means is a timer means operated synchronously with the stapling operation.

5. A sheet binding apparatus according to claim 2, wherein the signal output by said second timing output means is output immediately before the timing of a needle clinching operation.

6. A sheet binding apparatus according to claim 1, wherein said first and second timing output means comprise in combination rotary means which is rotated synchronously with the rotation of the motor for pressing the needle into the sheet stack, with a sensor for detecting a position of said rotary means.

7. A sheet binding apparatus according to claim 1, wherein said first and second timing output means is a timer means operated synchronously with the stapling operation.

8. An image forming apparatus having an image forming means, and a sheet binding apparatus for effecting a stapling operation in which a needle is pressed into a sheet stack by moving a head by operation of a motor, comprising:

first timing output means for outputting a signal at a timing of the needle pressing operation;

second timing output means for outputting a signal at a timing other than the timing of the needle pressing operation;

electrical load measuring means for measuring an electrical load value on the motor when the head moves, in response to the signals from said first and second timing output means;

base value setting means for setting an electrical load base value on which a judgement of the presence and absence of the needle is based; and judging means for calculating a difference value between electrical load values measured by the electrical load measuring means in response to signals from said first and second timing output means, and for comparing the difference value with the value set by said base value setting means to judge the presence and absence of the needle.

9. An image forming apparatus according to claim 8, wherein said first and second timing output means comprise in combination rotary means which is rotated synchronously with the rotation of the motor for pressing the needle into the sheet stack, with a sensor for detecting a position of said rotary means.

10. A sheet binding apparatus according to claim 8, wherein said first and second timing output means is a timer means operated synchronously with the stapling operation.

11. A sheet binding apparatus for effecting a stapling operation in which a needle is pressed into a sheet stack by moving a head by operation of a motor, comprising:

first timing output means for outputting a signal at a timing of the needle pressing operation;

second timing output means for outputting a signal at a timing other than the timing of the needle pressing operation;

electrical load measuring means for measuring an electrical load value on the motor when the head moves, in response to the signals from said first and second timing output means;

base value setting means for setting an electrical load base value on which a judgment of the presence and absence of the needle is based; and judging means for comparing a difference value between electrical load values measured by the electrical load measuring means in response to signals from said first and second timing output means with the value set by said base value setting means to judge the presence and absence of the needle.

12. An image forming apparatus having an image forming means, and a sheet binding apparatus for effecting a stapling operation in which a needle is pressed into a sheet stack by moving a head by operation of a motor, comprising:

first timing output means for outputting a signal at a timing of a needle pressing operation;

second timing output means for outputting a signal at a timing other than the timing of the needle pressing operation;

electrical load measuring means for measuring an electrical load value on the motor when the head moves, in response to the signals from said first and second timing output means;

base value setting means for setting an electrical load base value on which a judgement of the presence and absence of the needle is based; and judging means for comparing a difference value between electrical load values measured by the electrical load measuring means in response to signals from said first and second timing output means with the value set by said base value setting means to judge the presence and absence of the needle.

13. An apparatus according to claims 1, 8, 11, or 12, wherein the electrical load value is a current value flowing in the motor, and the electrical load base value is a current value determined in advance, and each of the current values is obtained by A/D converting a voltage inputted into a control circuit.

14. An apparatus according to claims 1, 8, 11, or 12, wherein the electrical load value is a current value flowing in the motor, and the electrical load base value is a current value determined in advance.

15. An apparatus according to claim 14, wherein the current value determined in advance is determined based on a current value generated at the timing of the needle pressing operation in the absence of the needle.

16. A sheet binding apparatus for effecting a stapling operation in which a needle is pressed into a sheet stack by moving a head by operation of a motor, comprising:

timing output means for outputting a first signal at a first timing of a needle pressing operation, and for outputting a second signal at a second timing before the needle pressing operation, during one stapling operation;

electrical load value measuring means for measuring an electrical load value on the motor at each of the first and second timings when the head moves, in response to the first and second signals from said timing output means; and judging means for comparing a difference value between electrical load values measured by the electrical load value measuring means in response to the first and second signals from said timing output means with a previously-set, adjustable reference value, on which a presence and absence of the needle is based, to judge the presence and absence of the needle.

17. A sheet binding apparatus according to claim 16, wherein said timing output means comprises in combination a rotary means which is rotated synchronously with the rotation of the motor for pressing the needle into the sheet stack with a sensor for detecting a position of said rotary means.

18. A sheet binding apparatus according to claim 16, wherein said timing output means is a timer means operated in synchronous with the stapling operation.

19. An image forming apparatus having an image forming means, and a sheet binding apparatus for effecting a stapling operation in which a needle is pressed into a sheet stack by moving a head by operation of a motor, comprising:

timing output means for outputting a first signal at a first timing of a needle pressing operation, and for outputting a second signal at a second timing before the needle pressing operation, during one stapling operation;

electrical load value measuring means for measuring an electrical load value on the motor at each of the first and second timings when the head moves, in response to the first and second signals from said timing output means; and judging means for comparing a difference value between electrical load values measured by the electrical load value measuring means in response to the first and second signals from said timing output means with a previously-set, adjustable reference value, on which a presence and absence of the needle is based, to judge the presence and absence of the needle.

20. An apparatus according to claim 16 or 19, wherein the electrical load value is a current value flowing in the motor, and the reference value is a current value determined in advance, and each of the current values is obtained by A/D converting a voltage inputted into a control circuit.

21. An apparatus according to claims of 16 or 19, wherein the electrical load value is a current value flowing in the motor, and the reference value is a current value determined in advance.

22. An apparatus according to claim 21, wherein the current value determined in advance is determined based on a current value generated at the timing of the needle pressing operation in the absence of the needle.

23. A sheet binding apparatus for effecting a stapling operation in which a needle is pressed into a sheet stack by moving a head by operation of a motor, comprising:

first timing output means for outputting a signal at a timing of a needle pressing operation;

second timing output means for outputting a signal at a timing other than the timing of the needle pressing operation;

electrical load value measuring means for measuring an electrical load value on the motor when the head moves, in response to the signals from said first and second timing output means;

base value setting means for setting an electrical load base value on which a judgement of the presence and absence of the needle is based; and judging means for calculating a difference value between electrical load values measured by the electrical load value measuring means in response to signals from said first and second timing output means, and for comparing the difference value with the value set by said base value setting means to judge the presence and absence of the needle, wherein said first and second timing output means comprises in combination a rotary means, which is rotated synchronously with the rotation of the motor for pressing the needle into the sheet stack, with a sensor for detecting a position of said rotary means, the signal output by said first timing output means being output at a timing when the needle is clinched, the signal output by said second timing output means being output immediately before the timing of a needle clinching operation, and the judgement that the needle is present being made when the difference value is larger than the base value.

24. An image forming apparatus having an image forming means, and a sheet binding apparatus for effecting a stapling operation in which a needle is pressed into a sheet stack moving a head by operation of a motor, comprising:

first timing output means for outputting a signal at a timing of a needle pressing operation;

second timing output means for outputting a signal at a timing other than the timing of the needle pressing operation;

electrical load value measuring means for measuring an electrical load value on the motor when the head moves, in response to the signals from said first and second timing output means;

base value setting means for setting an electrical load base value on which a judgement of the presence and absence of the needle is based; and judging means for calculating a difference value between electrical load values measured by the electrical load value measuring means in response to signals from said first and second timing output means, and for comparing the difference value with the value set by said base value setting means to judge the presence and absence of the needle, wherein said first and second timing output means comprises in combination a rotary means, which is rotated synchronously with the rotation of the motor for pressing the needle into the sheet stack, with a sensor for detecting a position of said rotary means, the signal output by said first timing output means being output at a timing when the needle is clinched, the signal output by said second timing output means being output immediately before the timing of a needle clinching operation, and the judgement that the needle is present being made when the difference value is larger than the base value.

25. An apparatus according to claim 23 or 24, wherein the electrical load value is a current value flowing in the motor, and the electrical load base value is a current value determined in advance, and each of the current values is obtained by A/D converting a voltage inputted into a control circuit.

26. An apparatus according to claim 23 or 24, wherein the electrical load value is a current value flowing in the motor, and the electrical load base value is a current value determined in advance.

27. An apparatus according to claim 26, wherein the current value determined in advance is determined based on a current value generated at the timing of the needle pressing operation in the absence of the needle.

28. A sheet binding apparatus for effecting a stapling operation in which a needle is pressed into a sheet stack by moving a head by operation of a motor comprising:

electrical load value measuring means for measuring an electrical load value on the motor when the head moves at a first timing of a needle pressing operation and at a second timing before the needle pressing operation, during one stapling operation; and judging means for comparing a difference value between electrical load values measured by the electrical load value measuring means measuring in response to a first signal output from a timing output means at the first timing and in response to a second signal output from the timing output means at the second timing, with a previously-set, adjustable reference value, on which a presence and absence of the needle is based, to judge the presence and absence of the needle.

29. An image forming apparatus having an image forming means, and a sheet binding apparatus for effecting a stapling operation in which a needle is pressed into a sheet stack by moving a head by operation of a motor, comprising:

electrical load value measuring means for measuring an electrical load value on the motor when the head moves at a first timing of a needle pressing operation and at a second timing before the needle pressing operation, during one stapling operation; and judging means for comparing a difference value between electrical load values measured by the electrical load value measuring means measuring in response to a first signal output from a timing output means at the first timing and in response to a second signal output from the timing output means at the second timing, with a previously-set, adjustable reference value, on which a presence and absence of the needle is based, to judge the presence and absence of the needle.

30. An apparatus according to claim 28 or claim 29, wherein the electrical load value is a current value flowing in the motor, and the reference value is a current value determined in advance, and each of the current values is obtained by A/D converting a voltage inputted into a control circuit.

31. An apparatus according to claim 28 or claim 29, wherein the electrical load value is a current value flowing in the motor, and the reference value is a current value determined in advance.

32. An apparatus according to claim 31, wherein the current value determined in advance is determined based on a current value generated upon the stapling operation with no needle effected in advance.

33. A sheet binding apparatus for effecting a staple operation in which a needle is pressed into a sheet stack by moving a head by operation of a motor, comprising:

an electrical load measuring means for measuring an electrical load value on the motor when the head moves, at both of a first timing of a needle pressing operation and a second timing other than the first timing at the needle pressing operation, during one stapling operation; and judging means for comparing a difference value between electrical load values measured by the electrical load value measuring in response to a first signal output from a timing output means at the first timing and a second signal output from the timing output means at the second timing, with a previously-set, adjustable reference value, on which a presence and absence of the needle is based, to judge the presence and absence of the needle.

34. An apparatus according to claim 33, wherein the electrical load value is a current value flowing in the motor, and the reference value is a predetermined current value, and each current value is obtained by A/D converting a respective voltage inputted into a control circuit.

35. A sheet binding apparatus according to claim 33, wherein the timing of the needle pressing operation is a timing when the needle is clinched, and the timing other than the timing of the needle pressing operation is a timing which is immediately before the timing of when the needle is clinched operation.

36. An apparatus according to claim 35, wherein the reference value is based on a current value generated at the timing of a needle processing operation in the absence of the needle.

* * * * *

UNITED STATES PATENT AND TRADEMARK OFFICE

CERTIFICATE OF CORRECTION

PATENT NO. : 6,062,454
DATED : May 16, 2000
INVENTOR(S) : Yugi Morishige, et al.

It is certified that error appears in the above-identified patent and that said Letters Patent is hereby corrected as shown below:

Column 1,
Line 12, "relates" should read -- relates to --.

Column 2,
Line 58, "counter clockwise" should read -- counterclockwise --.

Column 3,
Line 6, "in synchronous" should read -- synchronously --.

Column 4,
Line 21, "CPU" should read -- CPU 5 --; and
Line 54, "facing" should read -- facing up --.

Column 5,
Line 13, "a" should read -- an --.

Column 7,
Line 54, "previously-set, adjustable" should read -- previously-set --;
Line 55, "presence and" should read -- judgment of a presence and an --, and "based, to judge" should read -- based. --;
Line 56, should be deleted; and
Line 65, "in synchronous" should read -- synchronously --.

Column 8,
Line 17, "previously-set, adjustable" should read -- previously-set --;
Line 18, "presence and" should read -- judgment of a presence and an --, and "based, to judge" should read -- based. --; and
Line 19, should be deleted.

Column 9,
Line 63, "previously-set, adjustable" should read -- previously-set --;
Line 64, "presence and" should read -- judgment of a presence and an --; and
"based, to judge" should read -- based. --; and
Line 65, should be deleted.

Column 10,
Line 15, "previously-set, adjustable" should read -- previously-set --;
Line 16, "presence and" should read -- judgment of a presence and an --, and "based, to judge" should read -- based. --;
Line 17, should be deleted;

UNITED STATES PATENT AND TRADEMARK OFFICE

CERTIFICATE OF CORRECTION

PATENT NO. : 6,062,454
DATED : May 16, 2000
INVENTOR(S) : Yugi Morishige, et al.

It is certified that error appears in the above-identified patent and that said Letters Patent is hereby corrected as shown below:

Column 10,
Line 28, "claim 31," should read -- claim 30, --;
Line 35, "load" should read -- load value --;
Line 39, "at" should read -- of --;
Line 44, "measuring" should read -- measuring means --;
Line 47, "previously-set, adjustable" should read -- previously-set --;
Line 48, "presence and" should read -- judgement of a presence and an --;
Line 49, "based, to judge the presence and absence of" should read --based. --;
Line 50, should be deleted; and
Line 61, "clinched operation." should read -- clinched. --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*